US007108543B2

(12) United States Patent
Higashide

(10) Patent No.: US 7,108,543 B2
(45) Date of Patent: Sep. 19, 2006

(54) CONNECTOR STRUCTURE WITH A FLEXIBLE FLAT CABLE HOLDING MEMBER

(75) Inventor: Atsushi Higashide, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/283,051

(22) Filed: Nov. 21, 2005

(65) Prior Publication Data

US 2006/0110966 A1 May 25, 2006

(30) Foreign Application Priority Data

Nov. 22, 2004 (JP) ..... P2004-338135

(51) Int. Cl.
*H01R 12/24* (2006.01)

(52) U.S. Cl. ..... 439/495; 439/261

(58) Field of Classification Search ..... 439/495, 439/260, 261
See application file for complete search history.

(56) References Cited

U.S. PATENT DOCUMENTS 6,089,904 A * 7/2000 Wu ..... 439/495

FOREIGN PATENT DOCUMENTS

| | | |
|---|---|---|
| JP | UM-59-134387 | 9/1984 |
| JP | A-7-192822 | 7/1995 |
| JP | A-7-296911 | 11/1995 |
| JP | A-10-22009 | 1/1998 |

* cited by examiner

*Primary Examiner*—Hae Moon Hyeon
(74) *Attorney, Agent, or Firm*—Morgan, Lewis & Bockius LLP

(57) ABSTRACT

A connector structure includes: a housing having a substantially U-shaped cross section; a flexible flat cable inserted through an opening of the housing; and a junction terminal which has a substantially tuning-fork-shaped cross section and is formed integrally with the housing. The junction terminal has a contacting inward projection at its opening side upper and lower position. The projection electrically contacts with a conductive section of the flexible flat cable. A terminal extending from an inner part of the housing to be connected with a board. A vertical holding member into which an end of the flexible flat cable is inserted is provided at an innermost part of the housing.

6 Claims, 4 Drawing Sheets

PRIOR ART FIG. 9A

CONNECTOR STRUCTURE WITH A FLEXIBLE FLAT CABLE HOLDING MEMBER

BACKGROUND OF THE INVENTION

1. Field of the Invention

The present invention relates to a connector structure of an optical pickup unit and a connector structure. This connector structure includes a junction terminal inside its housing. Contacting inward projections are formed at the upper and the lower positions of the distal ends of the junction terminal, and the rear end of the junction terminal is connected with a board through a terminal. A flexible flat cable is inserted into the housing. A conductive section of the flexible flat cable contacts the contacting inward projections of the junction terminal so that continuity between the conductive section and the contacting inward projections can be provided.

2. Description of the Related Art

According to a typical connector structure of this type included in an optical pickup unit, a connector C is attached to an optical pickup unit 101 via a board 102 as illustrated in FIG. 7. In a conventional structure, contacting inward projections 105 are provided at the upper and lower positions of the distal ends of a junction terminal 104 which is equipped inside a housing 103 of the connector C. A terminal 106 of the junction terminal 104 is attached to the board 102. A flexible flat cable 107 is inserted into the housing 103, and a conductive section 108 of the flexible flat cable 107 contacts the contacting inward projections 105 of the junction terminal 104 so that continuity between the conductive section 108 and the contacting inward projections 105 can be provided.

However, since an end of the flexible flat cable 107 inserted into the housing 103 is not fixed but freely movable as illustrated in FIG. 7, the flexible flat cable 107 moves upward and downward when the optical pickup unit 101 is shifted toward the inner periphery and the outer periphery of a disk and the flexible flat cable 107 is thus tensioned. This causes insufficient contact between the flexible flat cable 107 and the contacting inward projections 105 of the junction terminal 104 in some cases.

FIG. 8 illustrates a connector as a first related art. According to this connector, a terminal 204 is supported by a housing 201 having an insertion concave 202 as illustrated in FIG. 8. Contacts 206*a* and 207*a* are provided on first and second control pieces 206 and 207, respectively, which are formed on a terminal 204. A control piece 209 extends from the distal end of the second control piece 207. An inclined surface 217 for elastically deforming the control piece 209 is formed on a slider 211 which is inserted into and removed from the insertion concave 202 of the housing 201. When the slider 211 is pulled out, the inclined surface 217 presses the control piece 209 to open the clearance between the pair of the contacts 206*a* and 207*a* larger than the thickness of a conductive member A by the elastic deformation of the control piece 209. A terminal section of the conductive member A is inserted into the clearance between the contacts 206*a* and 207*a*. Then, the pressing force applied on the control piece 209 is released by pushing the slider 211 into the insertion concave 202 so that the terminal section of the conductive member A can be elastically supported between the pair of the contacts 206*a* and 207*a* (see JP-A-7-192822, for example).

In this structure, however, the conductive member A is difficult to be inserted since the space between a guide surface 210 and an introduction surface 213 is narrow and curved.

FIGS. 9A and 9B illustrate a terminal connecting section of a flat cable as a second related art. According to this terminal connecting section, a conductive section 303*a* of a flat cable 303 and a pressure-contact section 304*a* of a tab terminal 304 are inserted between contacts 301*c* and 301*c* of a junction terminal 301 as illustrated in FIG. 9A. Then, as illustrated in FIG. 9B, the tab terminal 304 is rotated until it is disposed in a vertically extending position so that the junction terminal 301 can be supported by the elastic force of elastic arms 301*b* and 301*b* (see JP-A-7-296911, for example).

In this structure, however, the structure is complicated using a large number of components since the tab terminal 304 is required.

FIGS. 10A and 10B illustrate a connecting device for a flexible printed board as a third related art. This connecting device for a flexible printed board includes a block 411 having a contact 414 and a concave 416 and a block 421 having a contact 422 and a projection 423 as illustrated in FIGS. 10A and 10B. The contact 414 is disposed in such a position as to be located between the contact 422 and the projection 423 when the blocks 411 and 421 come into contact with each other. A flexible printed board 405 is inserted into the concave 416, and the flexible printed board 405 is bended by the blocks 411 and 421 to be fixed thereto (see JP-UM-59-134387, for example).

In this structure, however, time and labor are required for assembling the blocks 411 and 421.

FIGS. 11A through 11D illustrate a flat cable connector as a fourth related art. According to this flat cable connector, an end of an inserted flat cable 550 and a tongue-shaped piece 542 of a slider 540 are pushed into a space between a thirteenth arm 533 and a twenty-third arm 534 so as to apply contact pressure to a region between a contact 535 and a conductive section of the flat cable 550 and to fix the slider 540 to an insulating housing 520 via a contact 530 through latch engagement of an engaging projection 536 as illustrated in FIGS. 11A through 11D (see JP-A-10-22009, for example).

In this structure, however, the flat cable 550 is difficult to be inserted, and the structure is complicated.

SUMMARY OF THE INVENTION

Accordingly, it is an object of the invention to provide a connector structure of an optical pickup unit and a connector structure which overcome the above drawbacks, wherein: the structure is simplified using a smaller number of components; a flexible flat cable can be easily inserted into the connector; an end of the flexible flat cable can be supported on the inner part of the connector; and insufficient contact between a junction terminal of the connector and a conductive section of the flexible flat cable can be prevented.

According to an aspect of the invention, there is provided with a connector structure attached to a board of an optical pickup unit which operates at the time of reading from or writing to a disk, including: a housing which is made of resin and has a substantially U-shaped cross section; a flexible flat cable being inserted through an opening side of the housing; and a junction terminal which has a substantially tuning-fork-shaped cross section and is formed integrally with the housing, the junction terminal including: a contacting inward projection at upper and lower positions of the opening side of the housing, the contacting inward projection being electrically contact with a conductive section of the flexible flat cable; and a terminal extending from an inner part of the housing to be connected with the board of the optical pickup unit, wherein a hollow space is provided in an inner region of the housing inside the contacting inward projection. A vertical holding member into which an end of the flexible flat cable is inserted is provided at an innermost part of the housing so that the flexible flat cable can be supported at two points by the contacting inward projection and the vertical holding member.

By thus configuration, the flexible flat cable is supported at two positions by the vertical holding member provided at the innermost part of the housing when the flexible flat cable is inserted into the housing. Thus, the flexible flat cable does not move upward and downward within the housing when the optical pickup unit is shifted toward the inner or outer periphery and the flexible flat cable is thus tensioned. As a result, insufficient contact between the contacting inward projections of the junction terminal and the conductive section of the flexible flat cable can be prevented. Additionally, since the hollow space is provided in the inner region of the housing inside the contacting inward projections, the flexible flat cable can be easily inserted into the housing. Furthermore, the structure can be simplified using a smaller number of components.

According to another aspect of the invention, there is provided with a connector structure, including: a housing having a substantially U-shaped cross section; a flexible flat cable inserted through an opening of the housing; and a junction terminal which has a substantially tuning-fork-shaped cross section and is formed integrally with the housing, the junction terminal including a contacting inward projection at upper and lower positions of an opening side of the housing, the contacting inward projection being electrically contact a conductive section of the flexible flat cable, and a terminal extending from an inner part of the housing to be connected with a board. A vertical holding member into which an end of the flexible flat cable is inserted is provided at an innermost part of the housing.

By thus configuration, the end of the flexible flat cable is supported by the vertical holding member provided at the innermost part of the housing when the flexible flat cable is inserted into the housing. Thus, the flexible flat cable does not move upward and downward within the housing. As a result, insufficient contact between the contacting inward projections of the junction terminal of the connector and the conductive section of the flexible flat cable can be prevented. Furthermore, the structure can be simplified using a smaller number of components.

According to another aspect of the invention, a hollow space is provided in an inner region of the housing inside the contacting inward projection.

By thus configuration, the hollow space is provided in the inner region of the housing inside the contacting inward projections. Thus, the flexible flat cable can be easily inserted into the housing.

According to another aspect of the invention, the vertical holding member extends from the housing.

By thus configuration, the vertical holding member extends from the housing. Thus, the vertical holding member can be formed integrally with the housing.

According to another aspect of the invention, the vertical holding member is formed by bending the inner part of the junction terminal.

By thus configuration, the vertical holding member is formed by bending the inner part of the junction terminal. Thus, the vertical holding member can be easily produced only by bending the junction terminal.

According to another aspect of the invention, a tapered surface for guiding the inserted flexible flat cable are formed on an end of the vertical holding member at the flexible flat cable entrance side.

By thus configuration, the end of the flexible flat cable can be smoothly guided to the vertical holding member using the tapered surface.

BRIEF DESCRIPTION OF THE DRAWINGS

FIGS. 9A and 9B illustrate a terminal connecting section of a conventional flat cable, wherein: FIG. 9A is a vertical cross-sectional view showing a condition where a conductive section of a flat cable and a pressure-contact section of a tab terminal are inserted into a junction terminal; and FIG. 9B is a vertical cross-sectional view showing a condition where the tab terminal is shifted from the position in FIG. 9A to a vertically extending position.

FIGS. 10A and 10B illustrate a conventional connecting device for a flexible printed board, wherein: FIG. 10A is a vertical cross-sectional view after assembling the connecting device; and FIG. 10B is a disassembled vertical cross-sectional view before assembling the connecting device.

FIGS. 11A through 11D illustrate sequential steps for connecting a flat cable to a conventional connector for a flat cable, wherein: FIG. 11A is a vertical cross-sectional view of a first step; FIG. 11B is a vertical cross-sectional view of a second step; FIG. 11C is a vertical cross-sectional view of a third step; and FIG. 11D is a vertical cross-sectional view of a fourth step where the connection is completed.

DESCRIPTION OF THE PREFERRED EMBODIMENTS

A connector structure of an optical pickup unit and a connector structure in several embodiments according to the invention are hereinafter described with reference to the appended drawings.

Figure 1:
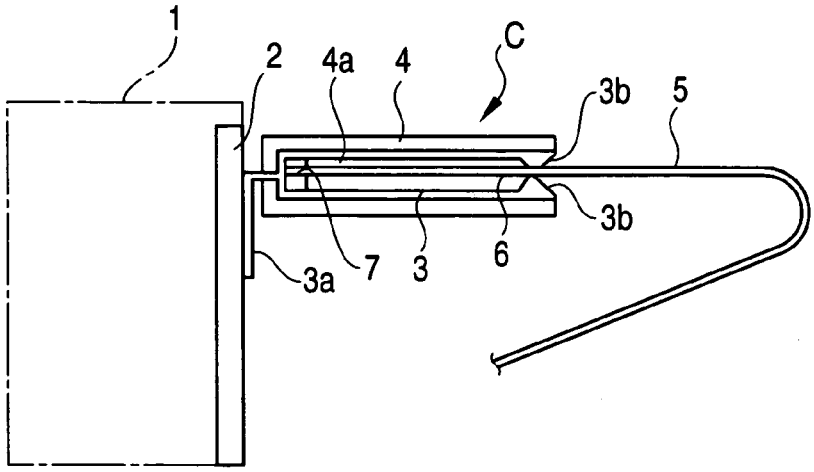
FIG. 1 is a front cross-sectional view schematically illustrating a connector structure of an optical pickup unit in a first embodiment according to the invention.
Figure 2:
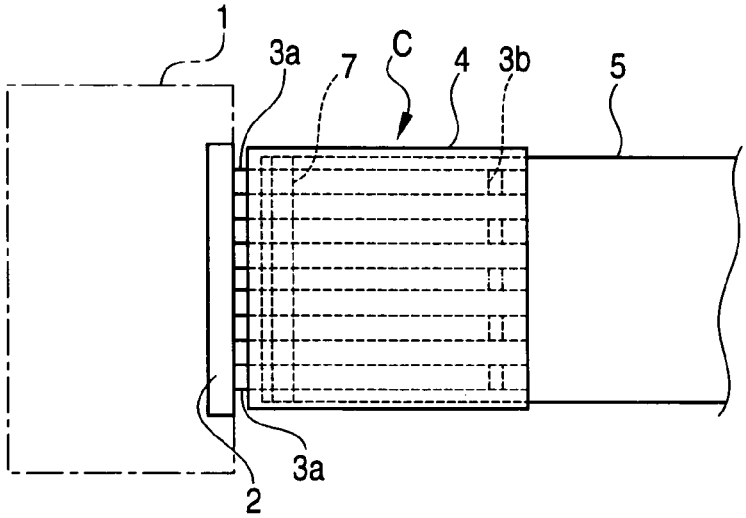
FIG. 2 is a plan view schematically illustrating the connector structure.
Figure 3:
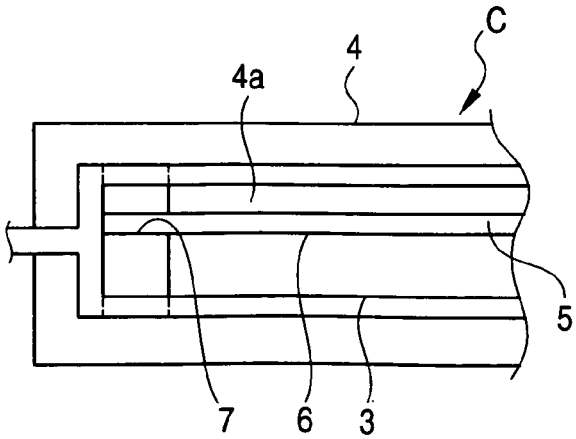
FIG. 3 is an enlarged front cross-sectional view of a main part of the connector structure.

FIG. 1 is a front cross-sectional view schematically illustrating a connector structure of an optical pickup unit in a first embodiment. FIG. 2 is a plan view schematically illustrating this connector structure. FIG. 3 is an enlarged front cross-sectional view showing a main part of the connector structure.

According to the connector structure of the optical pickup unit in the first embodiment shown in FIG. 1, a board 2 is attached to the side of an optical pickup unit 1. A terminal 3*a* of a junction terminal 3 of a connector C is fitted to the board 2. The junction terminal 3 has a substantially tuning-fork-shaped cross section, and is equipped within a housing 4. The housing 4 has a substantially U-shaped cross section. The junction terminal 3 extends along the upper and lower inner surfaces of the housing 4, and has contacting inward projections 3*b* and 3*b* at its ends. A hollow space 4*a* is provided in the inner region of the housing 4 inside the contacting inward projections 3*b* and 3*b*. A flexible flat cable 5 is inserted into the housing 4, and a conductive section 6 of the flexible flat cable 5 contacts the contacting inward projections 3*b* and 3*b* of the junction terminal 3 so that continuity between the conductive section 6 and the contacting inward projections 3*b* and 3*b* can be provided. As also illustrated in FIG. 3, a vertical holding member 7 for holding an end of the flexible flat cable 5 extends from the innermost part of the housing 4.

In the first embodiment, the end of the flexible flat cable 5 is supported at two positions by the vertical holding member 7 at the innermost position of the housing 4 and by the contacting inward projections 3*b* and 3*b* when the flexible flat cable 5 is inserted into the housing 4 of the connector C. Thus, the flexible flat cable 5 does not move upward and downward within the housing 4 when the optical pickup unit 1 is shifted toward the inner or outer periphery and the flexible flat cable 5 is thus tensioned. As a result, insufficient contact between the contacting inward projections 3*b* and 3*b* of the junction terminal 3 and the conductive section 6 of the flexible flat cable 5 can be prevented. Additionally, since the hollow space 4*a* is provided in the inner region of the housing 4 inside the contacting inward projections 3*b* and 3*b*, the flexible flat cable 5 can be easily inserted into the housing 4. Furthermore, the structure can be simplified using a smaller number of components.

Figure 4:
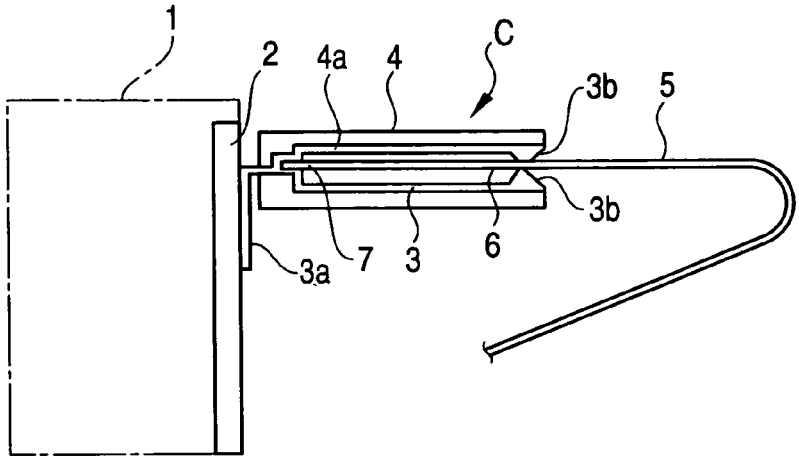
FIG. 4 is a front cross-sectional view schematically illustrating a connector structure of an optical pickup unit in a second embodiment according to the invention.

FIG. 4 is a front cross-sectional view schematically illustrating a connector structure of an optical pickup unit in a second embodiment. In the second embodiment, similar reference numerals are given to components and areas similar to those in the first embodiment described above, and the same explanation is not repeated herein.

As illustrated in FIG. 4, the connector structure of the optical pickup unit in the second embodiment includes a vertical holding member 7A formed by bending the inner part of the junction terminal 3.

In the second embodiment, the vertical holding member 7A is formed by bending the inner part of the junction terminal 3. Therefore, the vertical holding member 7A can be easily produced only by bending the junction terminal 3. Moreover, the flexible flat cable 5 does not move upward and downward within the housing 4 when the optical pickup unit 1 is shifted toward the inner or outer periphery and the flexible flat cable 5 is thus tensioned. As a result, insufficient contact between the contacting inward projections 3*b* and 3*b* of the junction terminal 3 and the conductive section 6 of the flexible flat cable 5 can be prevented.

Figure 5:
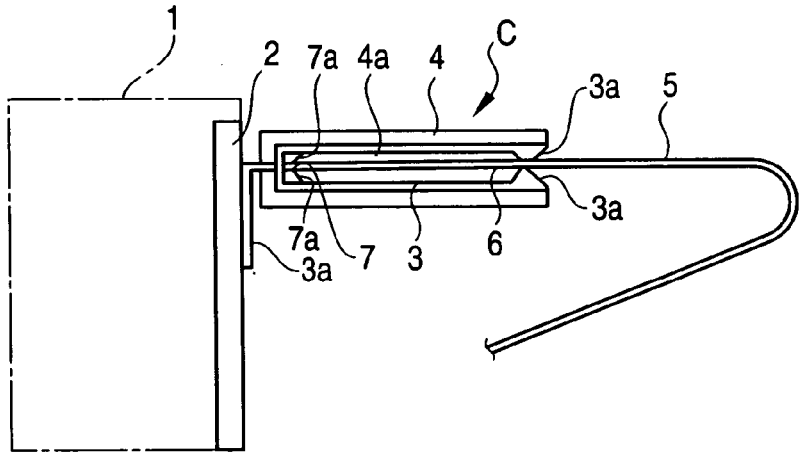
FIG. 5 is a front cross-sectional view schematically illustrating a connector structure of an optical pickup unit in a third embodiment according to the invention.

FIG. 5 is a front cross-sectional view schematically illustrating a connector structure of an optical pickup unit in a third embodiment. In the third embodiment, similar reference numerals are given to components and areas similar to those in the first embodiment described above.

The connector structure of the optical pickup unit in the third embodiment includes tapered surfaces 7*a* and 7*a*, which are provided at the cable entrance side upper and lower ends of the vertical holding member 7 extending from the housing 4 in the connector structure of the above first embodiment, so that the inserted flexible flat cable 5 can be guided using the tapered surfaces 7*a* and 7*a*.

In the third embodiment, therefore, the end of the flexible flat cable 5 can be smoothly guided along the tapered surfaces 7*a* and 7*a* toward the vertical holding member 7 during insertion.

Figure 6:
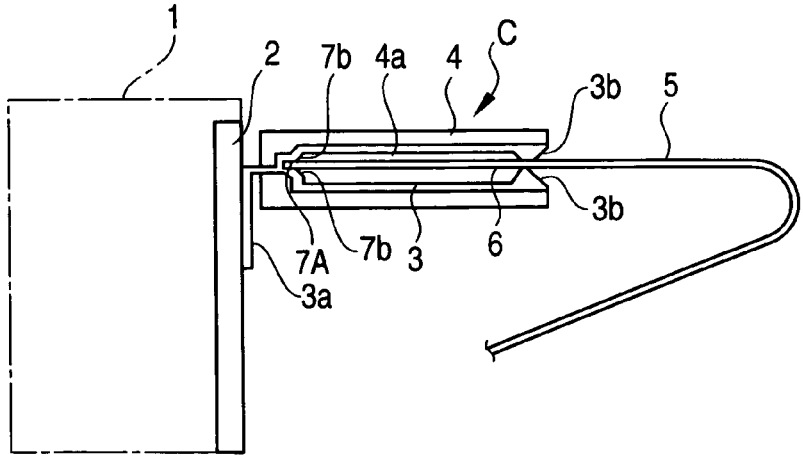
FIG. 6 is a front cross-sectional view schematically illustrating a connector structure of an optical pickup unit in a fourth embodiment according to the invention.
Figure 7:
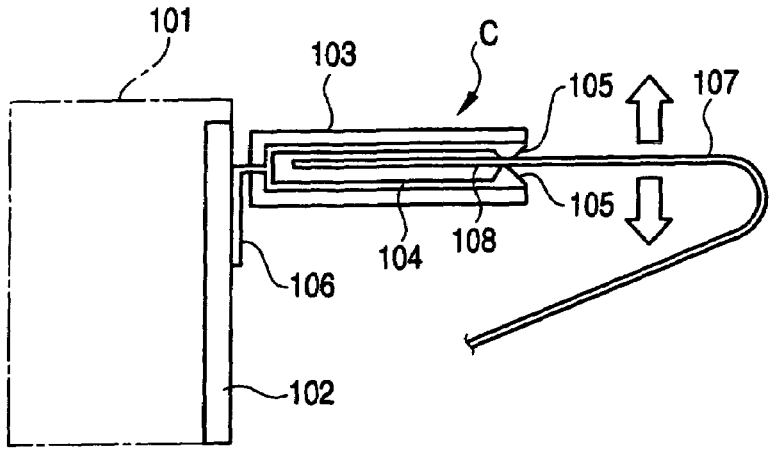
FIG. 7 PRIOR ART
FIG. 7 is a front cross-sectional view schematically illustrating a connector structure of a conventional optical pickup unit.
Figure 8:
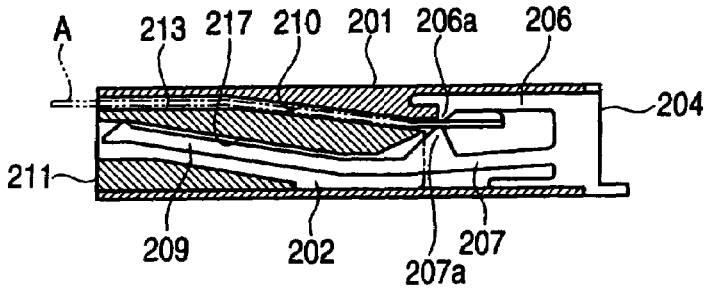
FIG. 8 PRIOR ART
FIG. 8 is a vertical cross sectional view of a conventional connector.
Figure 8:
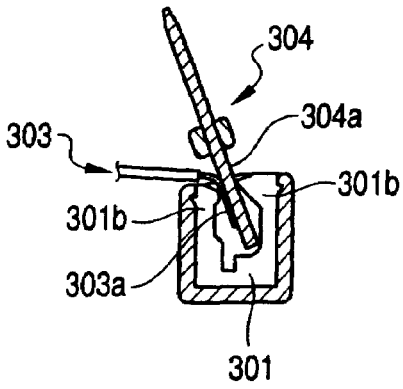
FIG. 8 PRIOR ART
Figure 9B:
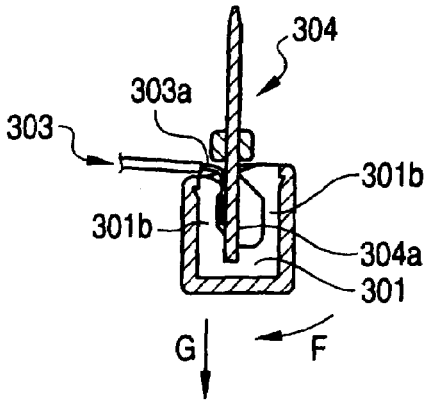
FIG. 9B PRIOR ART
Figure 10A:
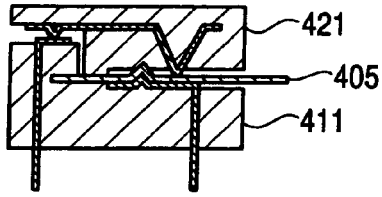
PRIOR ART FIG. 10A
Figure 10B:
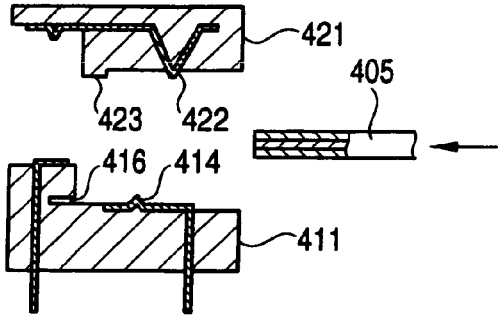
PRIOR ART FIG. 10B
Figure 11A:
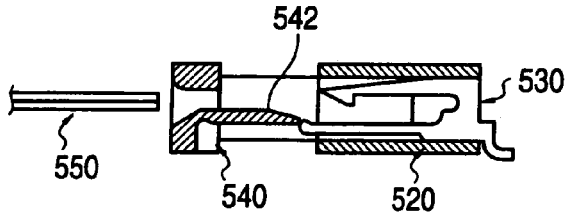
PRIOR ART FIG. 11A
Figure 11B:
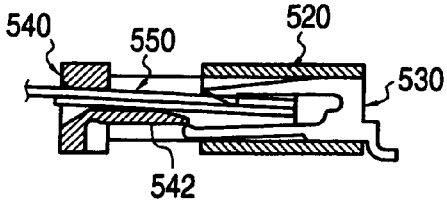
PRIOR ART FIG. 11B
Figure 11C:
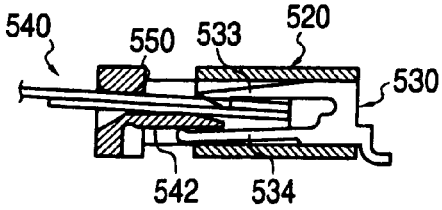
PRIOR ART FIG. 11C
Figure 11D:
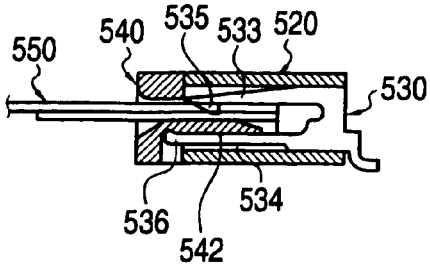
PRIOR ART FIG. 11D

FIG. 6 is a front cross-sectional view schematically illustrating a connector structure of an optical pickup unit in a fourth embodiment. In the fourth embodiment, similar reference numerals are given to components and areas similar to those in the first embodiment described above, and the same explanation is not repeated herein.

The connector structure of the optical pickup unit in the fourth embodiment includes tapered surfaces 7*b* and 7*b*, which are formed by bending the inner part of the junction terminal 3 and provided at the cable entrance side upper and lower ends of the vertical holding member 7A in the connector structure of the above second embodiment, so that the inserted flexible flat cable 5 can be guided using the tapered surfaces 7*b* and 7*b*.

In the fourth embodiment, therefore, the end of the flexible flat cable 5 can be smoothly guided along the tapered surfaces 7*b* and 7*b* of the vertical holding member 7A toward the vertical holding member 7A during insertion.

While the connector structure of the optical pickup unit has been discussed in the above respective embodiments, it is apparent that the invention is applicable to connector structures included in other electrical equipment.

What is claimed is:

1. A connector structure attached to a board of an optical pickup unit which operates at the time of reading from or writing to a disk, comprising:

a housing which is made of resin and has a substantially U-shaped cross section;

a flexible flat cable being inserted through an opening side of the housing; and a junction terminal which has a substantially tuning-fork-shaped cross section and is formed integrally with the housing, the junction terminal including:

a contacting inward projection at upper and lower positions of the opening side of the housing, the contacting inward projection being electrically contact with a conductive section of the flexible flat cable; and a terminal extending from an inner part of the housing to be connected with the board of the optical pickup unit, wherein a hollow space is provided in an inner region of the housing inside the contacting inward projection, and wherein a vertical holding member into which an end of the flexible flat cable is inserted is provided at an innermost part of the housing so that the flexible flat cable can be supported at two points by the contacting inward projection and the vertical holding member, and wherein the flexible flat cable has a first side and a second side opposite the first side such that the vertical holding member is in contact with both the first side and the second side of the flexible flat cable.

2. A connector structure, comprising:

a housing having a substantially U-shaped cross section;

a flexible flat cable inserted through an opening of the housing; and a junction terminal which has a substantially tuning-fork-shaped cross section and is formed integrally with the housing, the junction terminal including a contacting inward projection at upper and lower positions of an opening side of the housing, the contacting inward projection being electrically contact a conductive section of the flexible flat cable, and a terminal extending from an inner part of the housing to be connected with a board, wherein a vertical holding member into which an end of the flexible flat cable is inserted is provided at an innermost part of the housing so that the flexible flat cable can be supported at two points by the contacting inward projection and the vertical holding member, and wherein the flexible flat cable has a first side and a second side opposite the first side such that the vertical holding member is in contact with both the first side and the second side of the flexible flat cable.

3. A connector structure as set forth in claim 2, wherein a hollow space is provided in an inner region of the housing inside the contacting inward projection.

4. A connector structure as set forth in claim 2, wherein the vertical holding member extends from the housing.

5. A connector structure as set forth in claim 2, wherein the vertical holding member is formed by bending the inner part of the junction terminal.

6. A connector structure as set forth in claim 2, wherein a tapered surface for guiding the inserted flexible flat cable are formed an end of the vertical holding member at a flexible flat cable entrance side.

* * * * *